United States Patent [19]

Harris

[11] 4,116,779

[45] Sep. 26, 1978

[54] STARTING PROCEDURE FOR INTERNAL COMBUSTION VESSELS

[75] Inventor: Harry A. Harris, Rifle, Colo.

[73] Assignee: Paraho Corporation, Grand Junction, Colo.

[21] Appl. No.: 780,413

[22] Filed: Mar. 23, 1977

[51] Int. Cl.[2] ..... C10B 49/04

[52] U.S. Cl. ..... 201/34; 110/341; 201/36; 201/41; 208/11 R; 432/4

[58] Field of Search ..... 201/34, 36, 41; 208/11; 110/1 F; 432/4

[56] References Cited

U.S. PATENT DOCUMENTS

| | | | |
|---|---|---|---|
| 3,130,132 | 4/1964 | Sanders | 201/34 X |
| 3,464,913 | 9/1969 | Berry | 201/34 X |
| 3,519,539 | 7/1970 | Schulte | 201/36 X |
| 3,736,247 | 5/1973 | Jones, Jr. et al. | 201/36 X |
| 3,841,992 | 10/1974 | Jones, Jr. et al. | 201/34 X |

*Primary Examiner*—Morris O. Wolk
*Assistant Examiner*—Arnold Turk
*Attorney, Agent, or Firm*—Richard D. Law

[57] ABSTRACT

A vertical vessel, having a low bed of broken material, having included combustible material, is initially ignited by a plurality of ignitors spaced over the surface of the bed, by adding fresh, broken material onto the bed to buildup the bed to its operating depth and then passing a combustible mixture of gas upwardly through the material, at a rate to prevent back-firing of the gas, while air and recycled gas is passed through the bed to thereby heat the material and commence the desired laterally uniform combustion in the bed. The procedure permits precise control of the air and gaseous fuel mixtures and material rates, and permits the use of the process equipment designed for continuous operation of the vessel.

5 Claims, 5 Drawing Figures

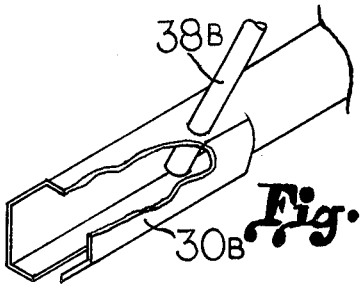
Fig. 4.
Fig. 3.
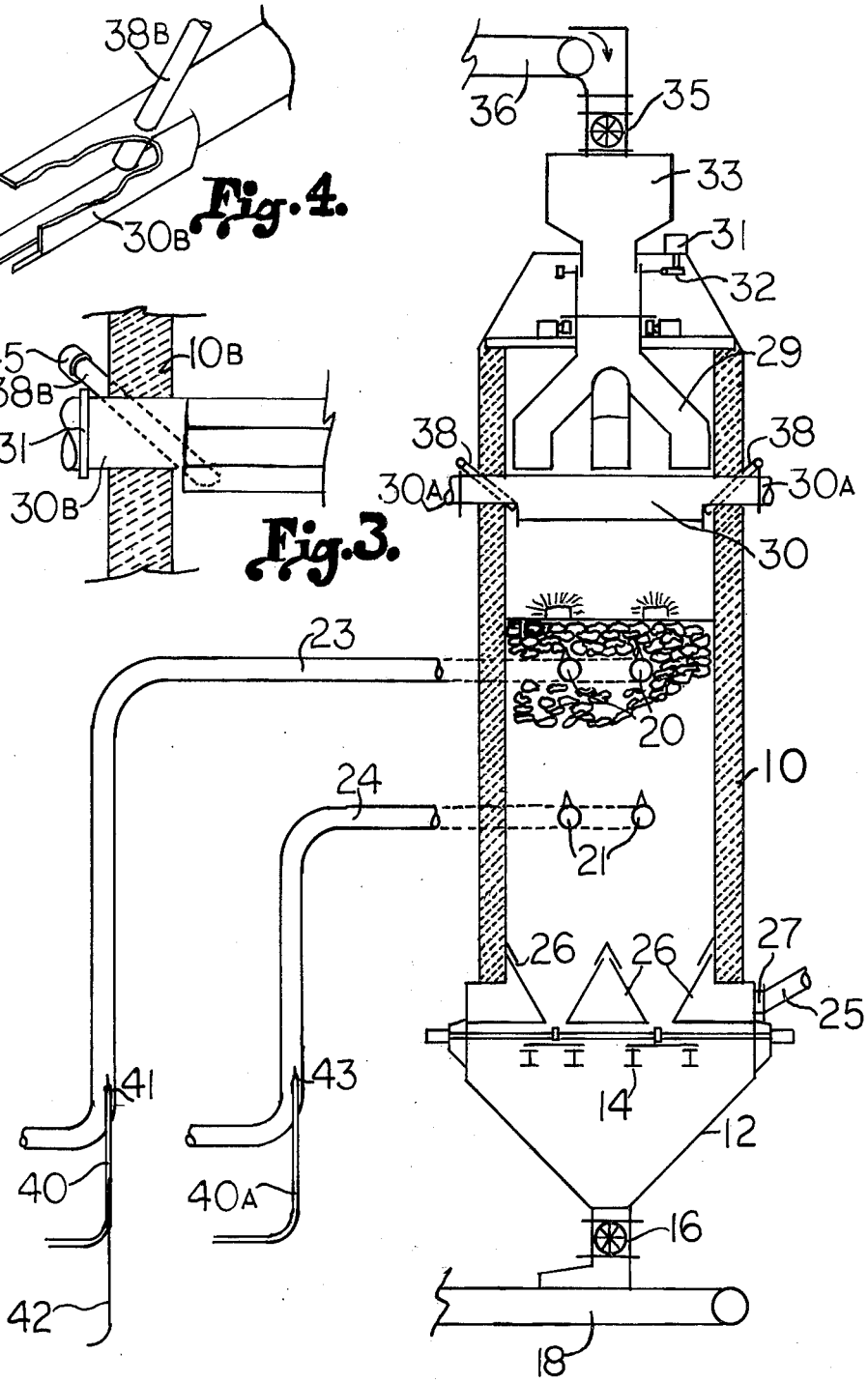
Fig. 1.

STARTING PROCEDURE FOR INTERNAL COMBUSTION VESSELS

This invention resulted from work done under Lease Agreement dated May 11, 1972, between the United States (represented by Honorable Rogers C. B. Morton, Secretary of the Interior) and Development Engineering, Incorporated.

PRIOR ART

Vertical, shaft vessels, referred to as retorts, kilns, shaft furnaces, etc., have been used for various pyrolitic reactions for different types of particulate materials. One type of pyrolitic reaction is an internal combustion in the vessel, providing the burning of included combustible material in the solid particulate material being treated. Examples of such an internal combustion reaction includes calcining a lime precursor by combusting gas or powdered coal mixed with the lime precursor; oil shale retorting; coking of coal; manufacture of cement; etc. A number of different types of procedures have been used to initiate the internal combustion, pyrolitic processes in the vertical shaft vessels. However, all development testing has been limited to vessels of small to medium cross-sectional and vertical dimensions. The used procedures have not been satisfactory in the small to medium size vessels, and have been considered nonusable for larger dimension commercial sized vessels, up to 40 feet in diameter.

The previously used startups have presented many problems which include lack of reliability of the startup procedure, leading to the continuous operation of the vessel upon reaching equilibrium conditions of the pyrolytic reaction; expense of revisions to the vessel and its auxiliary equipment; safety problems to personnel and equipment; the unadaptability of such procedures to larger diameter vessels; etc. Some of the startup procedures have involved the use of separate processing and auxiliary equipment designed and installed only for use in the starting procedure of the vessel. Such equipment, however, is required to stand idle during normal operations of the vessel, sometimes weeks and months. The requirements of pollution control during all operating conditions has, also, negated many of the previously used startup procedures.

One of the most widely used methods of startups, has employed a reversed draft principle, where a parallel or concurrent gas-solids flow is used during the startup. Following this startup procedure, the process gas flows must be reversed to establish the standard countercurrent gas-solids flow for normal vessel operations. The attempt to adapt this type of procedure to large, commercial size vessels calculate to be too expensive, and design-wise presents many operating and equipment problems. For example, in the reverse draft method for oil shale, an open shale bed is used, whereby the retort is partially filled with broken shale to a bed level within the system normally used for the zone of the combustion operating conditions. The bed is level and remains unfilled above this position during the starting procedures. An ignition fuel source is then spread on the surface of the bed, using such combustible material as wood, charcoal, coke, rags or other combustible material. A fire is initiated in the combustible material, so as to supply the necessary initial ignition of the combustible material of shale. A reverse or down draft is employed, pulling air from the top through to the bottom of the bed of shale. This pulls the hot gases from the combustion of the ignition material into the shale bed below, with the intent of igniting the material of the shale, and preventing excessive heat from reaching the upper retort mechanical loading equipment. The reverse draft is maintained until such time as it is assumed that the combustible material has ignited the shale particles sufficiently to maintain combustion of shale feed through the normal feeding equipment onto the upper surface of the initial bed. Fresh shale feed is then introduced into the vessel, and the feed is continued onto the bed of burning material until the retort is filled to its normal operative bed depth. During this procedure, the reversed draft is maintained until some time later when the draft is rapidly reversed so as to ignite the incoming feed of raw shale above the original burning surface. The initiation of combustion in the fresh shale on the bed must rely fully upon the ability of the combustible material (on the bed's surface) to ignite the cold raw shale applied to the bed's top surface following the reversal of the draft. This changes the direction of gas flow to an upward direction in the initial bed of shale into the vessel's normal operating mode.

A second method for initiating combustion in a shaft vessel, is to employ wall mounted burning systems or burners spaced around the outer periphery of the vessel in generally the same vertical level as that used for the combustible materials in the previous procedure, the surface of the open bed. In this wall burner procedure, a reverse draft is, also, used to draw the hot gases from the burners around the periphery of the vessel on to the surface of the open bed, and thus attempt to ignite the shale at this location. Once the shale in the initial bed has been ignited, cold, fresh, raw shale is added to the surface. The gas flows in the vessel are then reversed from the startup direction into their normal countercurrent operation when sufficient ignition is assumed.

The reverse draft system presents many problems in both of the above versions. One of the most pressing problems being the uneven heating of the surface of the shale, including the establishment of over-heating some areas and underheating other areas of the bed prior to establishing the desired retorting condition. In addition, portions of the bed may fail to ignite if the combustible material, added to the surface, has been allowed to burn quickly to ash or fails to properly ignite the shale. A failure to uniformly and properly ignite the bed surface is a characteristic of the use of the wall burners. Another problem in such procedures, is that following the actual ignition, an impact loading must be imposed on the remainder of the shale bed, since no provisions may be made to loosen the initial bed by the shale movement until after filling the retort to its normal operating depth. Another serious problem for this type of operating procedure, is the problem of extreme heat exposure to the upper part of the vessel including the raw shale feeding system, which is above the point of the initial ignition in the bed and above the normal combustion zone. Generally, this equipment is made of mild steel and serious problems result with this treatment as the equipment is overheated and exposed to high temperatures for long periods of time. The reverse draft system requires a flow of air from the top to the bottom of the open bed in the vessel, which, of course, means that the gas and other products of combustion must be withdrawn through the bottom discharge mechanism of the vessel. The products of the retorting operation are normally withdrawn from the top of the vessel, and the processing equipment extended from the off-gas system near the top of the vessel. The reverse draft system, however, requires some fluid process equipment connected with the bottom of the vessel, and such equipment must be capable of handling the oil produced during the retorting of the shale from the fire-off procedure. Additionally, some method must be employed to properly provide pollution controls for the gas generated during the startup procedure. Thus, it is noted that there is a high expense and difficulty of establishing a reverse draft system within a vertical vessel on small equipment and may be economically impossible on commercial size vessels. In addition, the time requirement for the reversal of the draft through the unit is highly critical, and experience has shown that this must be accomplished within a few minutes or a proper combustion will not occur at the interface of the hot combustible material and the cold raw shale being placed upon it. With the time requirement and the quantity of shale required to increase the bed to its normal depth for counter-current flow, it is difficult or impossible to obtain a preheat of the raw shale particle feed added to the bed. Therefore, the process conditions under this operation are highly susceptible to operating problems which may result in bed fusion, coking and coke agglomeration which in turn may force a premature shutdown of the operation.

In another startup procedure, there is the use of combustible materials upon an open bed, similar to that described, and using substantially the same bed depth as a reverse draft system. Solid fuel is used in this procedure with counter-current flow, rather than the reverse draft of the previous systems. In this procedure, however, live coals, such as burning charcoal, are initially placed and spread on the surface of a low height bed. Cold raw shale is then added to the top of the burning coals, and normal counter-current gas and air circulation is started. Problems from this startup procedure are in most cases similar to those of the reversed draft method, except that the normal process equipment may be used, rather than the auxiliary equipment used for the reverse gas flow system. The equipment and a system for the pre-ignition of the solid fuel, such as charcoal, coke or the like, must be available for supplying a substantial quantity of live coals to the retort bed surface. This, also, includes a method of handling such burning material and for placement across the bed of the shale. For large commercial size equipment, a large quantity of live coals are necessary for shale ignition. Thus, the equipment for producing the live coals, transportation to the open bed of shale, and the distribution of the live coals is extensive.

Another procedure used for a startup involves the use of hot air injection through the air-gas distributors. This procedure uses a full bed of crushed shale rather than the open beds used in the reverse draft procedures. The hot air or gas injection can be accomplished by a complete gas system, using an external or an inline heater system attached to the air or dilution system. This procedure will, of course, alleviate some of the problems associated with the impact loading, and the addition of cold shale to a partially filled retort. The primary disadvantage of this startup method is the requirement for the hot gas operating condition, and the change to a combustion mode of operation using counter-current gas-air and solid flows. The gas-air distributors of the vessel must be designed so as to withstand the injection of hot gas, hotter than pyrolysis temperature. The requirements of handling relatively large quantities of such hot gas involves expensive equipment. In addition, the bed of shale must be heated very quickly to temperatures capable of sustaining combustion, and a quick change from the hot gas indirect retorting mode to the direct combustion operating mode must be accomplished. Experience has shown that operating conditions necessary to achieve these high temperatures within the shale bed are, also, subject to process upsets. Thus, a full indirect, non-combustion mode, operating conditions must be achieved and maintained.

All of the previously used procedures involve process mechanical, operational and/or safety problems. Those using the reverse draft principle are considered impractical to adapt to larger dimension retorts. The use of an open bed or partially filled retorts present problems of impact loading of the shale particles during the filling of the remainder of the bed. The addition of cold shale to the surface results in process upsets of the beds and the chance of uneven ignition across the complete horizontal surface of the bed is always present. The open bed principle, also, involves serious safety problems, because of high temperatures developed in those equipment areas that are not normally subjected to high temperatures, and from the accumulation of explosive gas mixtures.

The indirect or hot gas addition startup procedure requires major design changes to the retort and added auxiliary equipment, all of a costly nature. This startup, also, presents problems of process upset, safety problems because of combustible gases produced at high temperatures. This startup procedure is, also, slow to initiate into an operational procedure.

The present invention relates to a unique startup procedure, developed to overcome the disadvantages of the previously used methods. The invention requires a source of gaseous fuel and a mixing nozzle in the air supply line to the air-gas distributor system. A method of inserting a series of relatively long firing ignitors onto the bed above the top gas distributor in the kiln is required. The cost of the special startup equipment into vertical kilns, according to the invention, and the fuel equipment revisions is essentially nil.

According to the present invention, the startup procedure provides a controlled internal combustion of gaseous fuel within a shale bed so as to preheat the shale particles to ignition temperature. When proper operating temperatures have been achieved within the bed, normal process flows are easily and quickly established, and the gaseous fuel supply is removed. One important feature of the invention is the preheating of the shale particles above the combustion zone. Thus there is provided a method of establishing the necessary operating conditions, producing the same vertical temperature profile in the shale bed as is required for continuous normal operations. The direct combustion of the gaseous fuel within the bed provides a rapid startup, with shale combustion temperatures being achieved within about 18 minutes or less of ignition of the gaseous fuel.

Included among the objects and advantages of the present invention is to provide equipment and process for performing a startup procedure for an internal combustion process in a vertical kiln.

Another object of the invention is to provide equipment for using a gaseous fuel to initiate a pyrolysis procedure for oil shale in a vertical kiln.

Still another object of the invention is to provide means for initiating a combustion of the desired combustible portions of an oil shale following the pyrolysis of the kerogen contained in the oil shale.

Yet another object of the invention is to provide fast, efficient startup procedure for an oil shale pyrolysis in a vertical kiln, ulitizing the equipment necessary for a normal continuous process, with a minimum of equipment modification of the normal processing equipment necessary for the direct combustion mode of operation of a vertical kiln.

These and other objects of the invention may be readily ascertained by referring to the following description and appended illustrations in which:

FIG. 1 is a cross-sectional view of a vertical kiln and in-gas flow systems for the kiln.

FIG. 3 is a cross-sectional detail of a charger for ignitors according to another form of the invention.

FIG. 4 is a cutaway perspective of an ignition charging tube, and

Figures 2, 5:
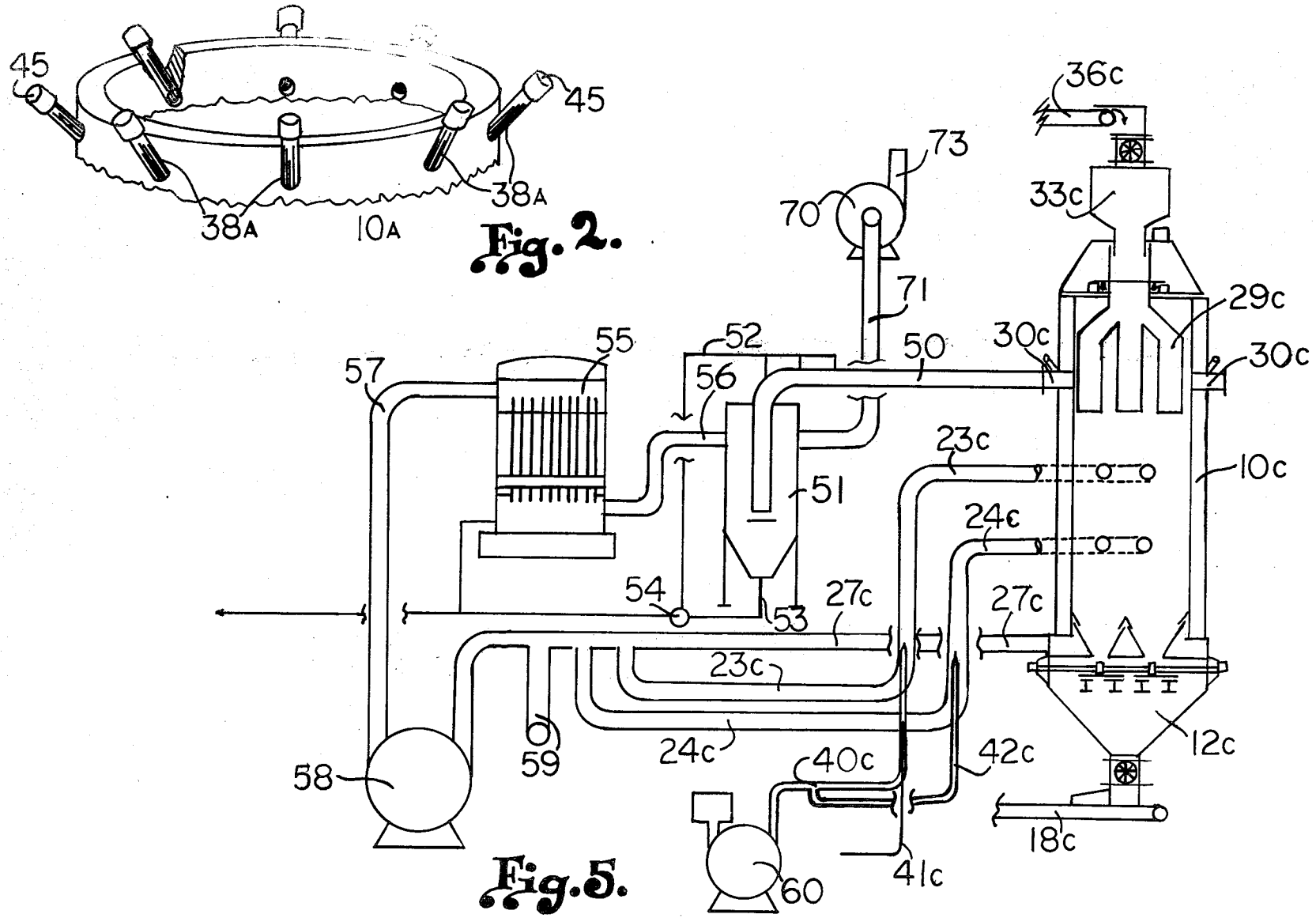
FIG. 2 is a schematic perspective detail of one form of charging equipment for ignitors according to the invention.
FIG. 5 is a schematic view of a modified form of the invention, illustrating some of the auxiliary equipment necessary for a startup procedure according to the invention and for continuous operating procedures for the kiln.

In the device illustrated in FIG. 1, a vertical vessel is shown which includes a central cylindrical shaft 10, which normally has a metal skin and refractory lining, providing an open vertical vessel. The bottom of the vessel is closed by a head 12, having a grate 14, at its upper end. A grate such as shown in U.S. Pat. No. 3,401,922 issued Sept. 17, 1968 provides a satisfactory means for discharge of solid material from the vessel into the head 12. A rotary discharger 16, at the bottom of the head, provides a controlled release of solid material withdrawn from the vessel, by the grate 14, and, also, provides a rotary airlock for the vessel. Retorted shale is deposited on retorted shale conveyor 18, providing a means for the transportation of retorted shale from the bottom of a vessel.

Gas is introduced into an upper portion of the vessel by means of upper distributors 20 and mid-distributors 21. These distributors may be similar to ones such as shown in U.S. Pat. No. 3,589,611 patented June 29, 1971. Gas for these distributors are introduced by means of lines usually introduced into both ends of the distributors which are exterior of the vessel. Thus, line 23 provides gaseous material for distributors 20, and line 24 provides gaseous material for distributors 21. Gas may be introduced into the bottom of the bed of particulate material in the vessel 10, by means of gas distributors 26. These are fed by a line 25 communicating with the inlet 27 for the bottom distributor 26. The bottom distributor may be of a type similar to that shown in U.S. Pat. No. 3,777,940 patented Dec. 11, 1973. Thus, for the example shown, gas may be introduced into a bed of particulate material at three levels. The number may be expanded or reduced. The particulate material, for continuous operation, is normally in a bed having a height from the grate 14 to the outlet of particulate feeder 29, which may be a series of pant legs for introducing particulate feed around the upper surface of the bed. The bed is normally maintained to a level at about the bottom of the feeder 29. The products of the pyrolysis and introduced gas may be withdrawn from the vessel by means of in-bed gas collecting manifolds 30, such as shown in U.S. Pat. No. 3,561,927, patented Feb. 9, 1971. The off-gas is withdrawn by lines **30*a***.

The particulate material may be introduced into the bed through distributor 29 which may be a rotary distributor for maintaining a substantially uniform depth of bed in the vessel, or other satisfactory feeding means. The rotary legs are fed by means of a control level feed hopper 33, which is a closed vessel providing means for maintaining feed in the legs. The legs are rotated by means of a motor 31 secured to a gear reduction mechanism 32 on the vessel top which rotates the legs in the vessel for uniform filling. The control level feed hopper 33 is a closed vessel, and it is fed by means of a rotary feeder 35, which provides a gas lock and means for introducing feed of particulate material into the hopper 33. A feed conveyor 36 deposits particulate feed over its head pulley into the rotary lock 35.

The startup procedure of the present invention provides a controlled internal combustion of an auxiliary gaseous fuel within the bed, to preheat the shale particles in the upper portions of the bed there to ignition temperature. The startup procedure according to the invention, provides for a bed of shale particles from the grate to a level slightly above the upper distributors 20. Ignitors are introduced onto the surface of the bed of shale through ignitor charging tubes 38 (FIGS. 1 & 2) which are spaced around the vessel, as desired, and extend through the wall. Through these, the ignitors may be charged into the kiln to fall onto the surface of the shale. The number of ignitors employed is dependent upon the retort size, but should include at least one ignitor above or nearly above each of the upper distributors to insure ignition of the fuel source independently of other distributors. For the purposes of the startup procedure, the top distributor 20 which is normally used for the injection of recycled gas and air into the bed, includes an air tube 40 connected into the line 23 with a mixing nozzle 41. Gaseous propane, or other gaseous fuel, is introduced through line 42 into the line 40 and through the mixing nozzle into line 23. Air may be injected into line 24 by means of an air line **40*a* which communicates with the inside of the line 24 through a mixing nozzle 43. This provides for an injection of air, along with recycled gas into the distributors 21**.

As shown in FIG. 2, a vertical vessel **10*a* is provided with a number of off-gas manifolds (not shown) determined by the size of the vessel. A series of ignitor charging tubes 38*a* extend through the vessel wall at an angle for charging ignitor onto the bed of shale. Each ignitor charging tube is provided with cap means 45**. The number of ignitor tubes is determined by the number of ignitors desired to be on the bed of the broken shale. The ignitors should be long lasting, some 20 minutes or more, and, of course, must easily pass through the chargers. An excellent ignitor is the pyrotechnic device called a railroad FUSEE or the similar highway warning flare.

An alternative form of the ignitor charging tubes is shown in FIGS. 3 and 4, wherein a vessel having a wall **10*b* with the off-gas collectors 30*b* extending therethrough, in the manner as shown in FIG. 1. The off-gas collectors may be flanged, as by a flange 31**, for connection to lines to the process equipment.

The schematic shown in FIG. 5 includes vertical vessel **10*c* provided with the head 12*c*, and a retorted shale discharge means 18*c*. Feed means 36*c* feeds control level hopper 33*c* into the vessel through rotating legs as described before. In this case, however, the off-gas outlets 30c are openings through the wall above the bottom end of feed legs 29c, and the off-gas is withdrawn through a line 50 into a coalescer 51. Gas is introduced into the vessel by the upper distributor tube 23c, to the mid-distributors 24c, and the bottom distributor by means of the line 27c. The coalescer 51 includes a spray system 52 which injects a spray of oil (from the bottom fluid discharge of the coalescer) by line 53 through a pump 54 into the off-gas entering the coalescer. The spray coalesces some of the condensable material withdrawn from the vessel through line 56 into an electrostatic precipitator 55. The coalescer and the electrostatic precipitator, schematically shown, are used in accordance with conventional procedures, for the recovery of approximately 99+% of the oil products from an oil shale retorting system, so that effectively non-condensible gases are withdrawn from the electrostatic precipitator through a line 57 by means of a blower 58. Some of this gas is recycled into the vessel through line 27c into the bottom of the vessel, line 23c into the upper distributors of the vessel and into the mid-distributors through line 24c. Product gas is recovered from line 59 on the pressure side from the blower to the vessel. An air blower 60 provides air through line 42c into line 24c for providing a controlled gas-air mixture into the mid-distributors 24c. The blower, also, provides air to line 40c into line 23c for a controlled mixture of gas and air into the upper distributors. Propane gas is introduced into the system by line 41c, along with air, into the line 23c** for the upper distributors in the vessel.

For purposes of the invention the slant tubes 38, FIG. 1, are employed through the wall of the vessel and these provide means of inserting ignitors, which may be railroad flares, or other long burning ignitors, onto the shale bed. The ignitor charging tubes are fabricated from 2 inch pipe with threaded exterior ends so that they may be capped with threaded caps, or other types of capping means for preventing out-flow of gas from the vessel. Thus, the ignitor charging tubes are easily opened and closed for the startup procedure. The lower internal ends of these ignitor charging tubes are open to permit the ignitors to be inserted into the vessel and fall onto the surface of the bed below the ignitor tube. Precise measurements of air and gaseous fuel introduced into the vessel are required at all times to provide a controlled combustion and in a requisite zone within the shale bed. Standard flow rate measurements and control methods are suitable, however, usual operation precautions including prestartup calibration, operation of safety checks, etc. must be made. Any source of high heating value fuel may be used, providing its combustion characteristics are known. Propane has been found highly suitable for this purpose.

As shown in the schematic flow diagrahm of FIG. 5, the gas-air mixing is shown for providing the combustion components for the two level distributors in the vertical retort. Air is supplied from the blower to the air-gas mixing nozzle and this mixture is passed through the piping to the top distributor, generally as a non-combustible fuel-rich mixture. Secondary air for the combustion is supplied from the same blower, but through the gas piping for introducing it through the mid-distributors. This is through line 24c. After the initial bed of shale is placed in the vessel, the ignitors are placed on the top surface of the bed through the ignitor charging tubes. Normal shale feed is introduced into the vessel, covering the ignitors, which continue to burn even in the shale bed. The shale flow is continued filling the bed to the level of the feeding system, as in conventional operation. For purpose of the startup procedure, however, a vent fan 70 draws gas through line 71 from the coalescer 51 and the electrostatic precipitator 55 through line 56 so that it may be discharged out line 73 for disposal. The vent blower 70 is normally not used during the initial stages of the startup procedure, but is used later.

TABLE I

| Step No. | Time Hrs | Time Min | Bottom Gas Flow SCFM | Mid Distributor Air Flow SCFM | Mid Distributor Gas Flow SCFM | Top Distributor Air Flow SCFM | Top Distributor Gas Flow SCFM | Top Distributor Propane Flow SCFM | Grate Speed Grate Setting T.P.H. | Time Required For Change |
|---|---|---|---|---|---|---|---|---|---|---|
| 1 | | 1 | — | 624 | — | 353.7 | — | 38.0 | — | |
| | | | | 30 | | 30 | | | | Sec. |
| 2 | | 1 | — | 575 | — | 400 | — | 38.0 | 0.7 | |
| | | | | 30 | | 30 | | | | Sec. |
| 3 | | 1 | — | 525 | — | 450 | — | 38.0 | 0.7 | |
| | | | | 30 | | 30 | | | | Sec. |
| 4 | | 5 | — | 472.7 | — | 515 | — | 38.0 | 0.7 | |
| | | | | | | | | 2 | | Min. |
| 5 | | 10 | — | 472.7 | — | 515 | — | 27.1 | 1.00 | |
| | | | 20 | 10 | | | 10 | | | Min. |
| 6 | 1 | | 882 | — | — | 515 | 220 | — | 6.0 | |
| | | | | | | 10 | 10 | | | Min. |
| 7 | 2 | | 1162 | — | 233 | 595 | 255 | — | 7.0 | |
| 8 | 2 | | 1467 | — | 233 | 651 | 236 | — | 8.0 | |
| 9 | 2 | | 1800 | — | 233 | 675 | 262 | — | 9.0 | |
| 10 | 2 | | 2000 | 75 | 95.5 | 675 | 262 | — | 10.0 | |
| 11 | | | 2200 | 150 | 238 | 675 | 250 | — | 11.0 | |

The startup sequence starts with the insertion of the ignitors onto the surface of the shale bed through the ignitor charging chutes, and the number of ignitors is normally dependant upon the retort size. The ignitors must be stable ignition sources under the gas-air velocity imposed through the shale bed, and they must be impervious to the physical abuse required when covered with the broken shale, and while passing downwardly in the movement of the bed of the broken shale. Subsequent to of the insertion of the ignitors, the ignitor charging tubes are closed, and flows of air and propane are initiated as shown in Table I. The rates in Table I apply to a 50 sq. ft. cross-section retort. step one of the procedure provides an ignition of the propane-air mixture, as an upward flow of a combination flow from both distributors, when it reaches the ignitors in an upper portion of the bed. The gas and air mixture to the top distributor provides a rich mixture which is above the combustible limits of the particular flow. Combustion, therefore, can not occur until the rich mixture is combined with the secondary air from the mid-distributor. The volume of gas leaving the distributor orifices is sufficient to provide a flow velocity above the flame propagation rates as a secondary safety measure. The air rate to the mid-distributors are set to provide stoichiometric quantities of air and gaseous fuel for combustion in the zone above the top distributor. The total flow rates of the gases are adjusted to provide gas velocities, within the void space of the shale particles in the bed, equal to or slightly less than the flame propagation rate. This permits the gas, upon ignition by the ignitor, to slowly burn down through the bed into zone of mixing of the air-gas mixture issuing from the top distributor and the air moving up through the bed from the mid-distributors. During step one the bed is steady as there is no shale being removed from the bottom of the bed or fed at the top. step one extends for about 1 minute, during which time the air flow through the mid-distributor set at 624 standard cubic feet (SCFM) per minute, while the air through the top distributors is set at 354 SCFM, along with 38 SCFM of the propane. Following the 1 minute duration of step one, step two is initiated during which the air flow to the mid-distributor is slightly reduced, the air flow to the upper distributor is slightly increased and the grate speed is set at point 0.7 T.P.H. (tons per hour). At the end of the minute of the second step, the third step is initiated where the mid-distributor air is further decreased but the air to the upper distributor is increased, using the same grate speed. Following the minute of operation of step three, step four is initiated for about a 5 minute period, in which the air to the mid-distributor is further reduced to 473 SCFM while the air to the top distributor is increased to 515 SCFM. At the end of the 5 minutes, step five is initiated for a 10 minute period using the same air flows to the two distributors, but reducing the amount of propane to 27 SCFM and increasing the grate speed setting to 1.0 T.P.H. The retort feed rate is set for normal operation. Following the step five procedure, step six procedure is initiated for 1 hour, in which recycled gas is introduced into the bottom distributor at 882 SCFM, while air is cut off the mid-distributor. The top distributor air is maintained at the same rate while the propane is cut off, and recycled gas is introduced at 220 SCFM, and the grate speed is increased to 6.0. Step seven follows step six for a period of 2 hours, and the recycled gas flow to the bottom distributor is increased to 1162 SCFM while recycle gas is introduced into mid-distributor without air at a rate of 233 SCFM. Air is introduced at 595 SCFM to the top distributor along with 255 SCFM of recycled gas and at a grate speed of 7.0 T.P.H. Following the 2 hour period for step seven, step eight is initiated for another 2 hours during which recycled gas is increased into the bottom distributor to 1467 SCFM with the same quantity of recycled gas flow to the mid-distributor. During this step air to the top distributor is increased to 651 SCFM while the recycled gas to the top is reduced to 236 SCFM with a grate speed of 8.0 T.P.H. Step nine is initiated following step eight for another 2 hour period with gas introduced into the bottom distributor of 1800 SCFM with the same amount of recycled gas as before in the mid-distributor. Air to the top distributor increased to 675 SCFM along with 262 SCFM of recycled gas. The grate speed is increased to 9.0 T.P.H. Following this period step 10 is initiated for 2 hour period in which 2000 SCFM of gas is introduced into the bottom distributor and 75 SCFM air and 95.5 SCFM recycle gas is introduced into the mid-distributor along with same quantity of recycled gas. The grate speed is increased to 10.0 T.P.H. Following step 10 the vessel goes into normal continuous operation with 2200 SCFM of gas into the bottom distributor, 150 SCFM of air and 238 SCFM of recycled gas into the mid-distributor while the air at 675 SCFM along with 250 SCFM of recycled gas is introduced into the top distributor. The grate speed is normally set for 11.0 T.P.H. to maintain the vessel full of shale, at normal feed and withdrawal rates.

A stepwise change is made of the various flow rate adjustments to simulate a continuous transition of the flow rate changes, rather than a sudden shift from one operating condition, to another. The table shows the stepwise sequence as the "time required for change". When step five has been completed at the end of about 18 minute period, sufficient heat has been obtained within the shale bed to support combustion in the normal retorting manner and the propane fuel is stopped. At the start of step six when the propane is removed from the entering air stream, the shale rates are rapidly increased as the combustion zone temperatures and other shale bed temperatures approach normal operating conditions. This provides for a recycled gas system which is started. Step six through 11 permits the initial combustion zone and the preheating zone of the shale bed to expand vertically to normal operating conditions.

As shown by the startup procedure, the top distributor only is employed during early periods of the change over from propane firing to the establishment of normal operations. During steps seven and eight the top distributor provides the only air addition, and air is added to the mid-distributor only following that period when hot retorted shale is available to this position so as to result in the combustion of the carbonaceous residue on the retorted shale. A continued buildup of flow rates is maintained to step 11 where full retort operations at moderate mass rate is achieved. The total time of lapse from the start of to the continuous retort operations is shown as slightly more than 9 hours.

Variations in the flow conditions shown for steps one through five must be confined to the principles described in the description of the gaseous firing steps. Using this system of the gaseous fuel injection, with the orifice controlled distributors, there are provided safety features for the startup. The use of the ignitors for ignition of the bed provides reliability and safety procedures in the fire off or startup procedure of a vertical vessel for retorting oil shale.

What is claimed is:

1. A start-up procedure for the continuous, internal combustion retorting process for a bed of oil shale in a vertical shaft vessel which has upper and mid level air-gas injection distributors intermediate the top and bottom of the vessel, bottom gas injection means and has shale feed means and retorted shale withdrawal means, comprising:

(a) forming a partial bed of shale in the vessel having a surface above the upper level air-gas injection distributor;

(b) placing a plurality of ignited railroad type flare ignitors spacedly across the surface of the bed;

(c) initially passing air into the shale bed through both distributors and then gradually passing an increasing volume of air through said upper and reducing air volume to the mid level air-gas injection means, and at flow rates below the flame propagation rate to hold combustion in the shale bed and above the upper air-gas injection means;

(d) simultaneously with step (c) injecting a combustible gaseous fuel through said upper distributor into the bed with the air to produce a rich mixture that is not combustible at the temperature of the bed of shale until combined with the air from the mid-distributor thereby forming a combustion zone above the upper distributor;

(e) initiating and gradually increasing raw shale feed onto the bed, covering the ignitors;

(f) initiating flow of recycle gas into the bed;

(g) initiating and gradually increasing retorted shale withdrawal, at a rate less than increased raw shale feed of (e), to thereby gradually raise the level of the shale bed to normal operating height in the vessel during ignition of said ignitors;

(h) gradually decreasing flow of gaseous fuel to a shut-off when ignition of shale is achieved during the time of ignition of said ignitors.

2. A startup procedure according to claim 1, wherein the initial injection of air into the mid-distributor is greater than the air into the upper distributor.

3. A startup procedure according to claim 1, wherein recycle gas is injected with air following the cutoff of the gaseous fuel.

4. A startup procedure according to claim 1, wherein the gaseous fuel is propane.

5. A startup procedure according to claim 4, wherein the quantities of air and propane are on a stoichiometric ratio in the combustion zone.

* * * * *